US006726028B2

(12) United States Patent
Visscher et al.

(10) Patent No.: US 6,726,028 B2
(45) Date of Patent: Apr. 27, 2004

(54) DE-INKING SCREEN

(75) Inventors: Engel Visscher, Schrool (NL); Sean Austin, Eugene, OR (US)

(73) Assignee: Bulk Handling Systems, Inc., Eugene, OR (US)

( * ) Notice: Subject to any disclaimer, the term of this patent is extended or adjusted under 35 U.S.C. 154(b) by 0 days.

(21) Appl. No.: 10/264,298

(22) Filed: Oct. 2, 2002

(65) Prior Publication Data

US 2003/0080033 A1 May 1, 2003

Related U.S. Application Data

(60) Provisional application No. 60/326,805, filed on Oct. 2, 2001.

(51) Int. Cl.[7] ..... B07B 13/05
(52) U.S. Cl. ..... 209/668; 209/673
(58) Field of Search ..... 209/668, 673

(56) References Cited

U.S. PATENT DOCUMENTS 6,253,927 B1 * 7/2001 Vaananen et al. ..... 209/668

* cited by examiner

*Primary Examiner*—Harold I. Pitts
(74) *Attorney, Agent, or Firm*—Marger Johnson & McCollom, PC

(57) ABSTRACT

Multiple shafts are aligned along a frame and configured to rotate in a direction causing paper products to move along a separation screen. The shafts are configured with a shape and spacing so that substantially rigid pieces of the paper products move along the screen while non-rigid pieces of the paper products slide down between adjacent shafts. In one embodiment, the screen includes at least one vacuum shaft that has a first set of air input holes configured to suck air and retain the non-rigid paper products. A second set of air output holes are configured to blow out air to dislodge the paper products retained by the input holes.

19 Claims, 6 Drawing Sheets

DE-INKING SCREEN

This application claims the benefit of provisional application No. 60/326,805 filed Oct. 2, 2001.

DESCRIPTION OF THE RELATED ART

Disc or roll screens are used in the materials handling industry for screening flows of materials to remove certain items of desired dimensions. Disc screens are particularly suitable for classifying what is normally considered debris or residual materials. This debris may consist of soil, aggregate, asphalt, concrete, wood, biomass, ferrous and nonferrous metal, plastic, ceramic, paper, cardboard, paper products or other materials recognized as debris throughout consumer, commercial and industrial markets. The function of the disc screen is to separate the materials fed into it by size or type of material. The size classification may be adjusted to meet virtually any application.

Disc screens have a problem effectively separating Office Sized Waste Paper (OWP) since much of the OWP may have similar shapes. For example, it is difficult to effectively separate notebook paper from Old Corrugated Cardboard (OCC) since each is long and relatively flat.

Accordingly, a need remains for a system that more effectively classifies material.

SUMMARY OF THE INVENTION

Multiple shafts are aligned along a frame and configured to rotate in a direction causing paper products to move along a separation screen. The shafts are configured with a shape and spacing so that substantially rigid or semi-rigid paper products move along the screen while non-rigid or malleable paper products slide down between adjacent shafts.

In one embodiment, the screen includes at least one vacuum shaft that has a first set of air input holes configured to suck air and retain the non-rigid paper products. A second set of air output holes are configured to blow out air to dislodge the paper products retained by the input holes.

DETAILED DESCRIPTION OF THE INVENTION

Figure 1:
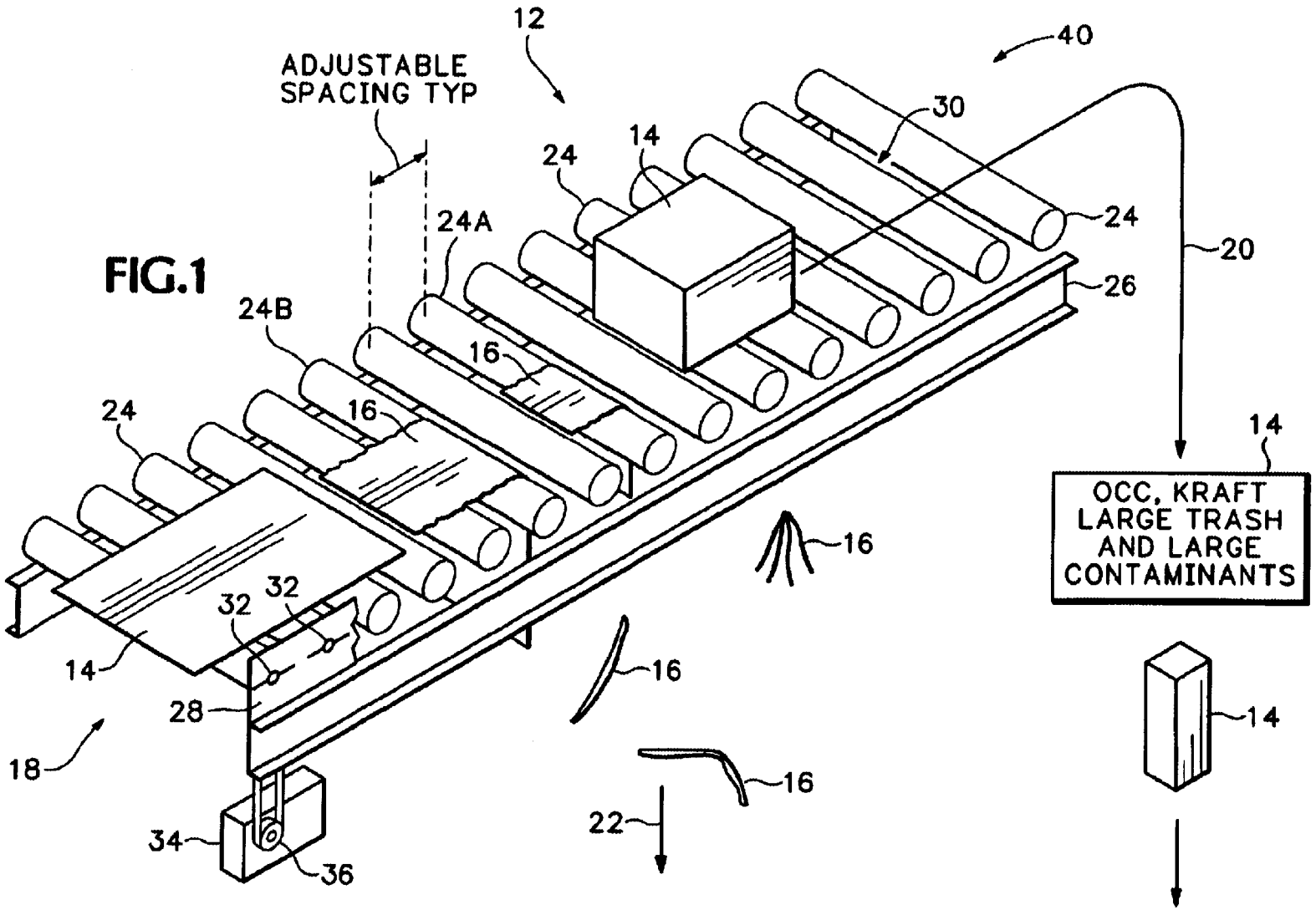
FIG. 1 is a schematic showing a single-stage de-inking screen.

Referring to FIG. 1, a de-inking screen 12 mechanically separates rigid or semi-rigid paper products constructed from cardboard, such as Old Corrugated Containers (OCC), kraft (small soap containers, macaroni boxes, small cereal boxes, etc.) and large miscellaneous contaminants (printer cartridges, plastic film, strapping, etc.) 14 from malleable or flexible office paper, newsprint, magazines, journals, and junk mail 16 (referred to as de-inking material).

The de-inking screen 12 creates two material streams from one mixed incoming stream fed into an in feed end 18. The OCC, kraft, and large contaminants 14 are concentrated in a first material stream 20, while the de-inking material 16 is simultaneously concentrated in a second material stream 22. Very small contaminants, such as dirt, grit, paper clips, etc. may also be concentrated with the de-inking material 16. Separation efficiency may not be absolute and a percentage of both materials 14 and 16 may be present in each respective material stream 20 and 22 after processing.

The separation process begins at the in feed end 18 of the screen 12. An in feed conveyor (not shown) meters the mixed material 14 and 16 onto the de-inking screen 12. The screen 12 contains multiple shafts 24 mounted on a frame 26 with brackets 28 so as to be aligned parallel with each other. The shafts 24 rotate in a forward manner propelling and conveying the incoming materials 14 and 16 in a forward motion.

Figure 6:
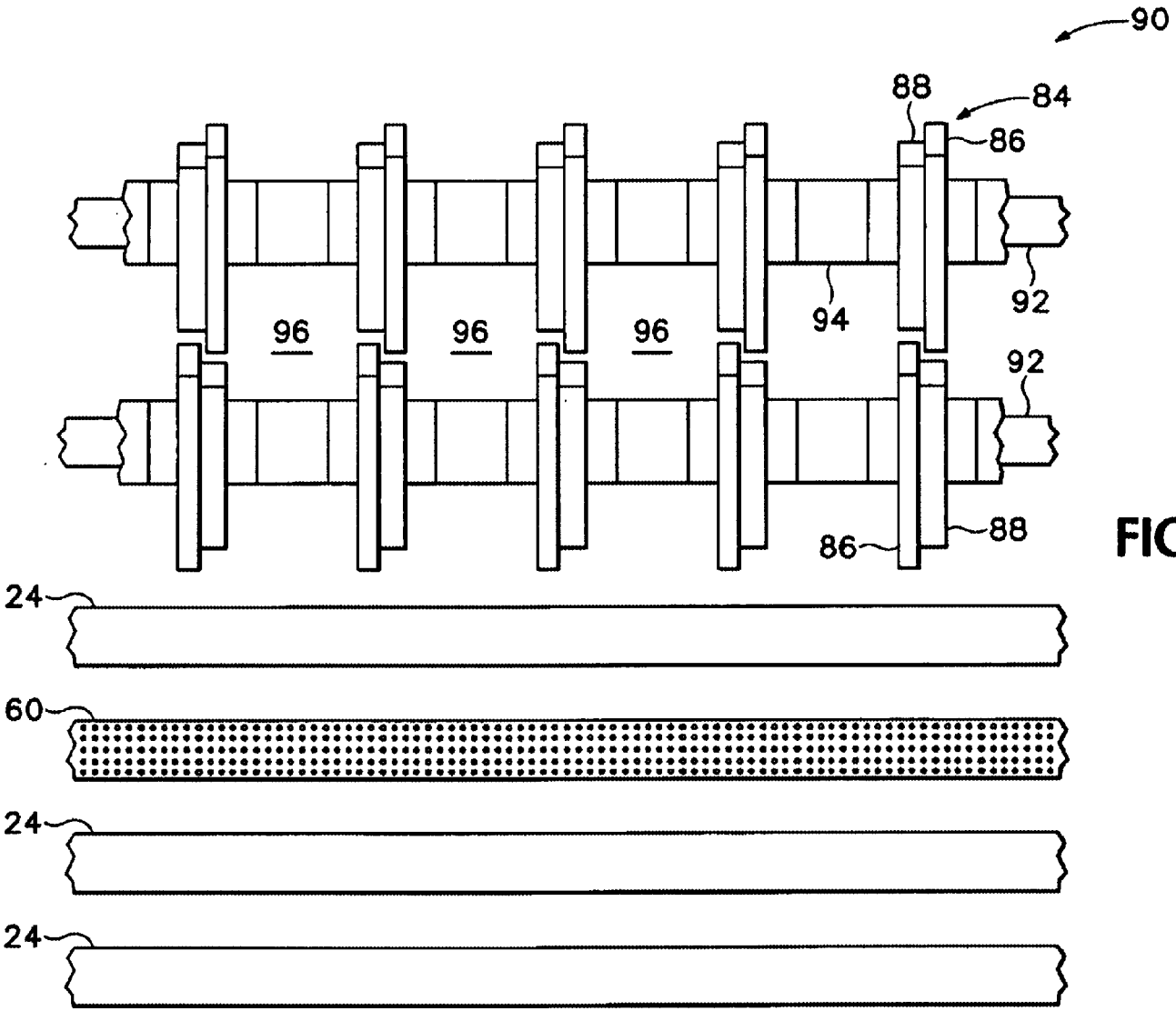
FIG. 6 is a plan view showing an alternative embodiment of the de-inking screen.

The circumference of some of the shafts 24 may be round along the entire length, forming continuous and constant gaps or openings 30 along the entire width of the screen 12 between each shaft 24. The shafts 24 in one embodiment are covered with a roughtop conveyor belting to provide the necessary forward conveyance at high speeds. Wrappage of film, etc. is negligible due to the uniform texture and round shape of the rollers. Alternatively, some of the shafts 24 may contain discs having single or dual diameter shapes to aide in moving the materials 14 and 16 forward. One disc screen is shown in FIG. 6.

The distance between each rotating shaft 24 can be mechanically adjusted to increase or decrease the size of gaps 30. For example, slots 32 in bracket 28 allow adjacent shafts 24 to be spaced apart at variable distances. Only a portion of bracket 28 is shown to more clearly illustrate the shapes, spacings and operation of shafts 24. Other attachment mechanisms can also be used for rotatably retaining the shafts 24.

The rotational speed of the shafts 24 can be adjusted offering processing flexibility. The rotational speed of the shafts 24 can be varied by adjusting the speed of a motor 34 or the ratio of gears 36 used on the motor 34 or on the screen 12 to rotate the shafts 24. Several motor(s) may also be used to drive different sets of shafts 24 at different rotational speeds.

Even if the incoming mixed materials 14 and 16 may be similar in physical size, material separation is achieved due to differences in the physical characteristics of the materials. Typically, the de-inking material 16 is more flexible, malleable, and heavier in density than materials 14. This allows the de-inking material 16 to fold over the rotating shafts 24A and 24B, for example, and slip through the open gaps while moving forward over the shafts 24.

In contrast, the OCC, kraft, and contaminants 14 are more rigid, forcing these materials to be propelled from the in feed end 18 of screen 12 to a discharge end 40. Thus, the two material streams 20 and 22 are created by mechanical separation. The de-inking screen 12 can be manufactured to any size, contingent on specific processing capacity requirements.

Figure 2:
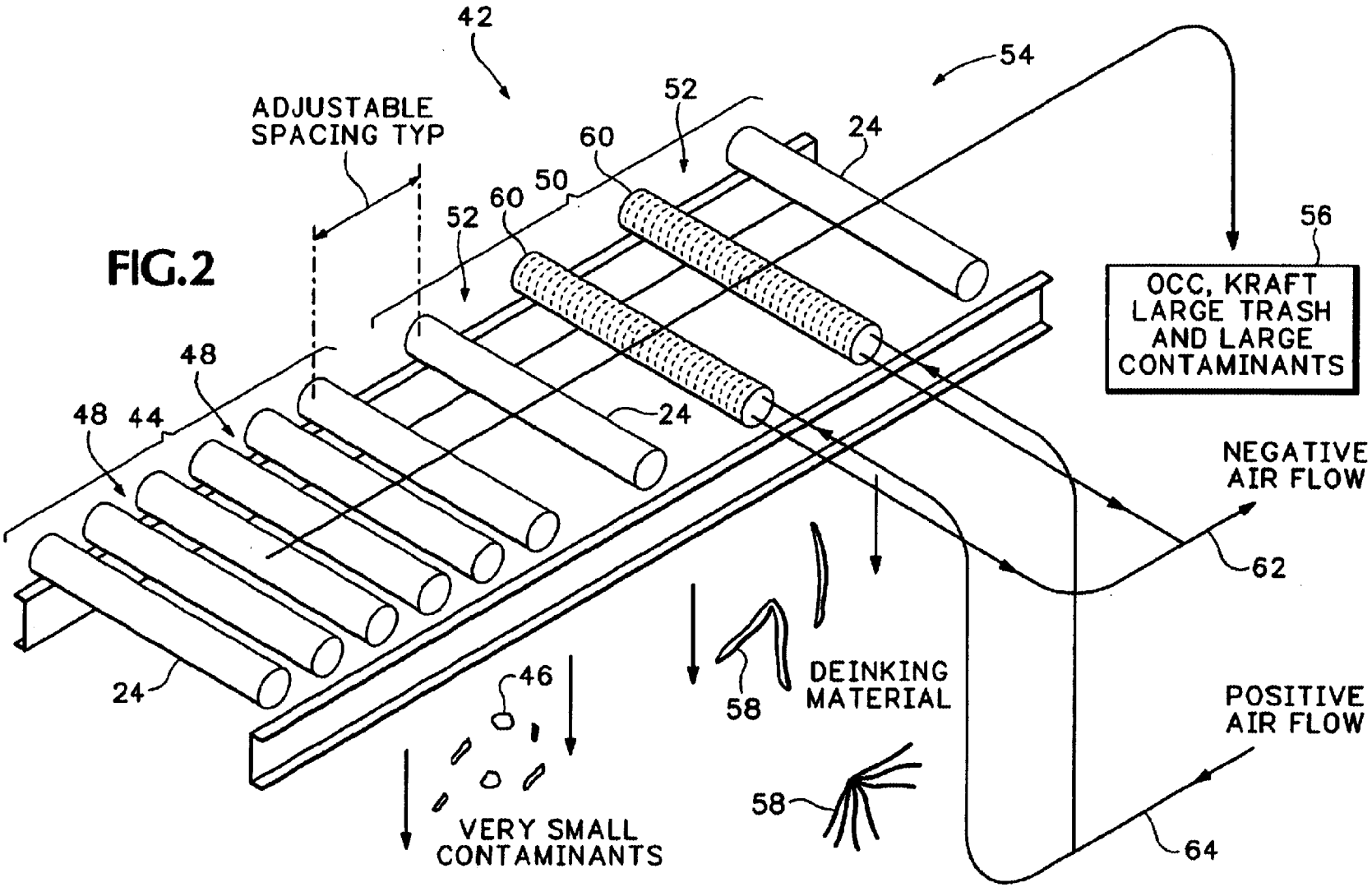
FIG. 2 is a schematic showing a dual-stage de-inking screen.

FIG. 2 shows a two-stage de-inking screen 42 that creates three material streams. The first stage 44 releases very small contaminants such as dirt, grit, paper clips, etc. 46 through the screening surface. This is accomplished using a closer spacing between the shafts 24 in first stage 44. This allows only very small items to be released through the relatively narrow spaces 48.

A second stage 50 aligns the shafts 24 at wider spaces 52 compared with the spaces 48 in first stage 48. This allows de-inking materials 58 to slide through the wider gaps 52 formed in the screening surface of the second stage 50 as described above in FIG. 1.

The OCC, kraft, and large contaminants 56 are conveyed over a discharge end 54 of screen 42. The two-stage screen 42 can also vary the shaft spacing and rotational speed for different types of material separation applications and different throughput requirements. Again, some of the shafts 24 may contain single or dual diameter discs to aide in moving the material stream forward along the screen 42 (see FIG. 6).

The spacing between shafts in stages 44 and 50 is not shown to scale. In one embodiment, the shafts 24 shown in FIGS. 1 and 2 are generally twelve inches in diameter and rotate at about 200–500 feet per minute conveyance rate. The inter-shaft separation distance may be in the order of around 2.5–5 inches. In the two-stage screen shown in FIG. 2, the first stage 44 may have a smaller inter-shaft separation of approximately 0.75–1.5 inches and the second stage 50 may have an inter-shaft separation of around 2.5–5 inches. Of course, other spacing combinations can be used, according to the types of materials that need to be separated.

Figure 3:
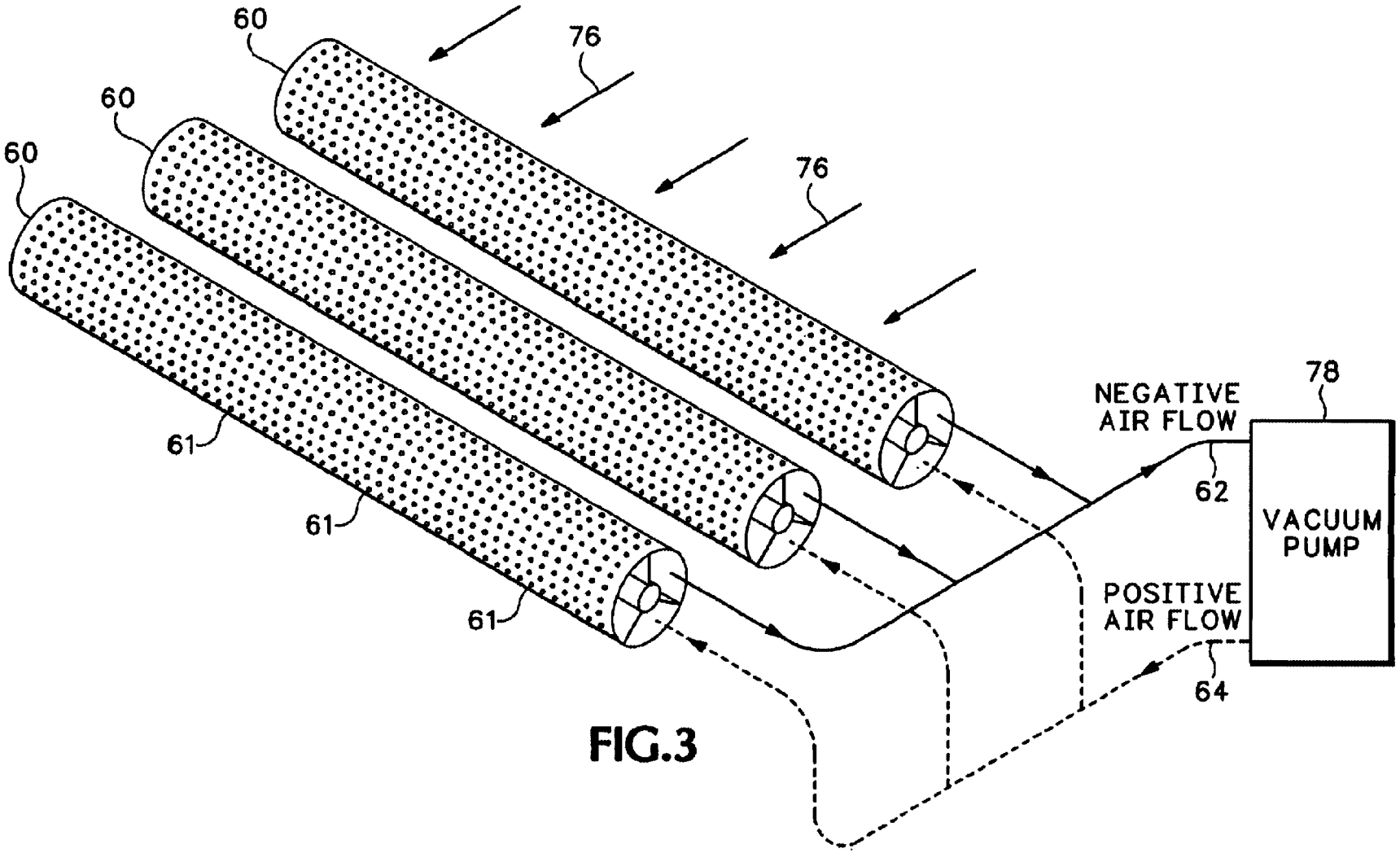
FIG. 3 is a schematic showing an isolated view of vacuum shafts used in the de-inking screens shown in FIGS. 1 or 2.
Figure 4:
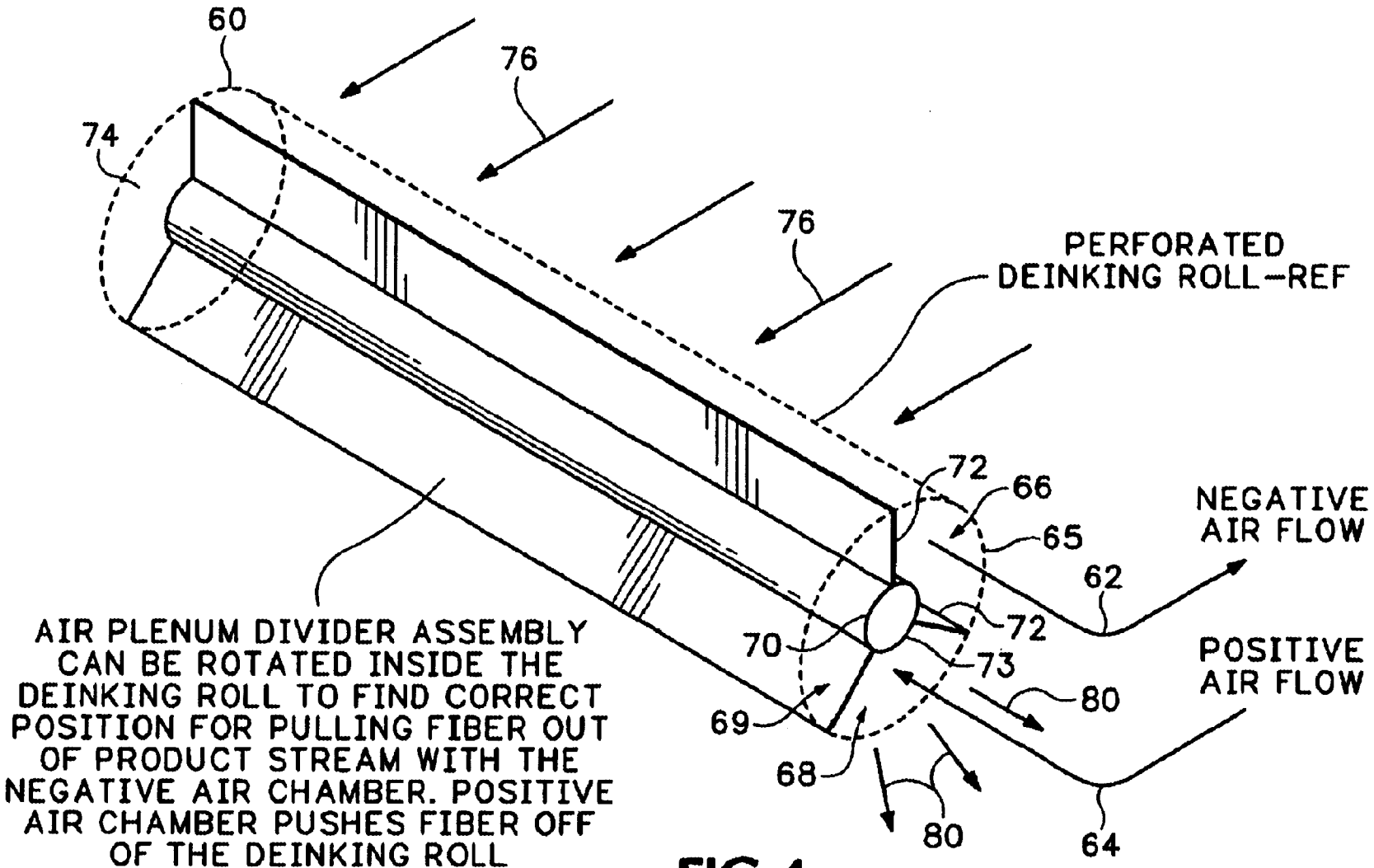
FIG. 4 is schematic showing an isolated view of a plenum divider that is inserted inside the vacuum shaft shown in FIG. 3.

Referring to FIGS. 2, 3 and 4, vacuum shafts 60 may be incorporated into either of the de-inking screens shown in FIG. 1 or FIG. 2. Multiple holes or perforations 61 extend substantially along the entire length of the vacuum shafts 60. In alternative embodiments, the holes 61 may extend only over a portion of the shafts 60, such as only over a middle section.

The vacuum shafts 60 are hollow and include an opening 65 at one end for receiving a plenum divider assembly 70. The opposite end 74 of the shaft 60 is closed off. The divider 70 includes multiple fins 72 that extend radially out from a center hub 73. The divider 70 is sized to insert into the opening 65 of vacuum shaft 60 providing a relatively tight abutment of fins 72 against the inside walls of the vacuum shaft 60. The divider 70 forms multiple chambers 66, 68 and 69 inside shaft 60. In one embodiment, the divider 70 is made from a rigid material such as steel, plastic, wood, or stiff cardboard.

A negative air flow 62 is introduced into one of the chambers 66 formed by the divider 70. The negative air flow 62 sucks air 76 through the perforations 61 along a top area of the shafts 60 that are exposed to the material stream. The air suction 76 into chamber 66 encourages smaller, flexible fiber, or de-inking material 58 to adhere to the shafts 60 during conveyance across the screening surface.

In one embodiment, the negative air flow 62 is restricted just to this top area of the vacuum shafts 60. However, the location of the air suction portion of the vacuum shaft 60 can be repositioned simply by rotating the fins 72 inside shaft 60. Thus, in some applications, the air suction portion may be moved more toward the top front or more toward the top rear of the shaft 60. The air suction section can also be alternated from front to rear in adjacent shafts to promote better adherence of the de-inking material to the shafts 60.

The negative air flow 62 is recirculated through a vacuum pump 78 (FIG. 3) to create a positive air flow 64. The positive air flow 64 is fed into another chamber 68 of the vacuum shafts 60. The positive air flow 64 blows air 80 out through the holes 61 located over chamber 68. The blown air 80 aides in releasing the de-inking material 58 that has been sucked against the holes of negative air flow chamber 66. This allows the de-inking material 58 to be released freely as it rotates downward under the screening surface. In one embodiment, the blow holes over chamber 68 are located toward the bottom part of the vacuum shaft 60.

The second stage 50 (FIG. 2) releases the de-inking material 58 through the screen surface. The stiffer cardboard, OCC, kraft, etc. material 56 continues over the vacuum shafts 60 and out over the discharge end 54 of the screen 42. The two-stage de-inking screen 42 can also vary shaft and speed.

Figure 5A:
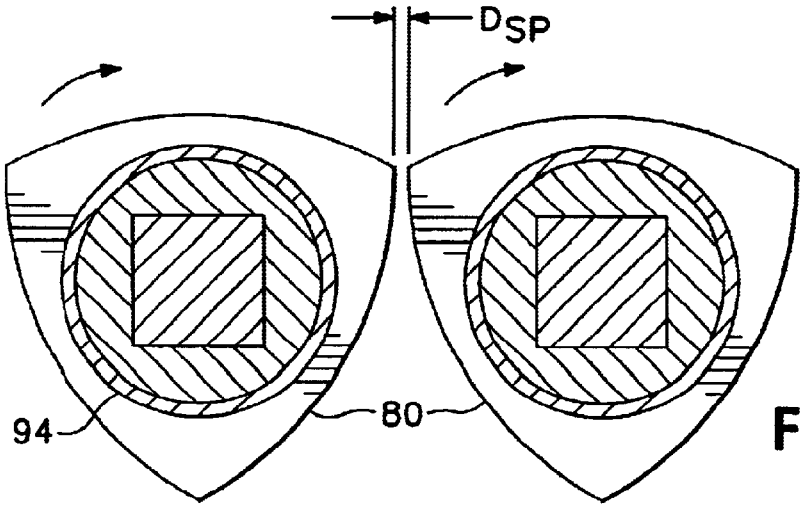
FIGS. 5A–5C show different discs that can be used with the de-inking screen.
Figure 5B:
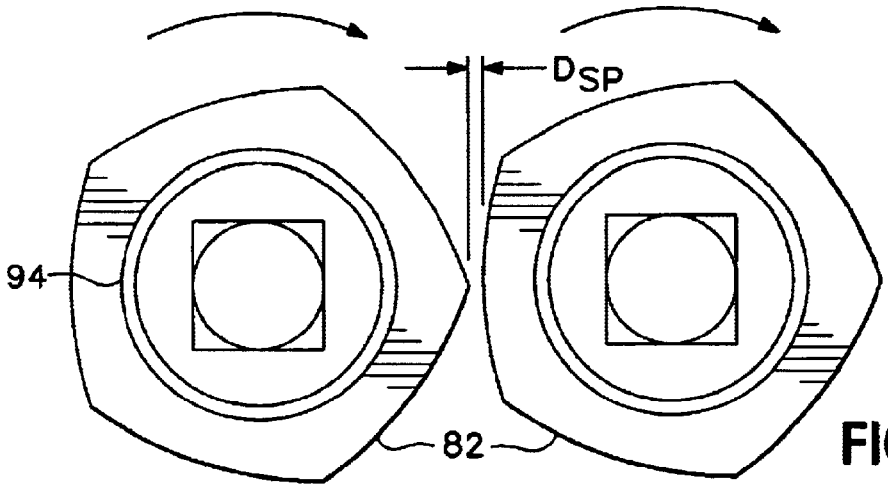
Figure 5C:
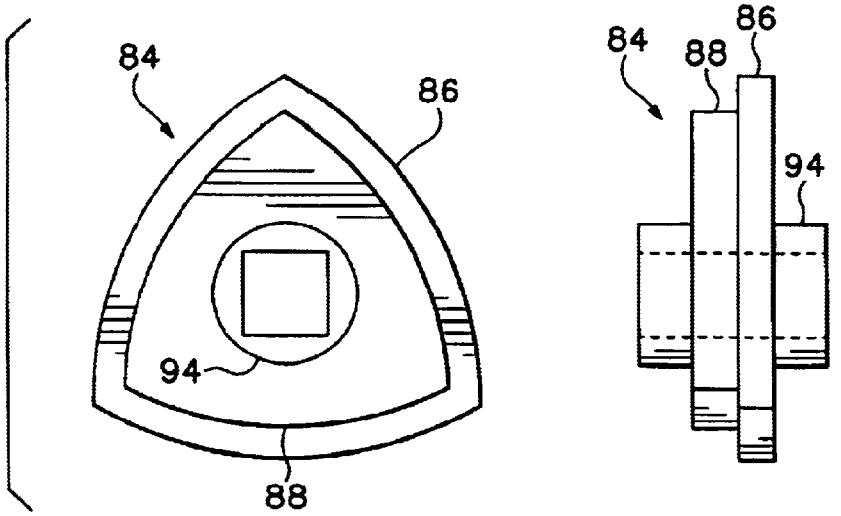

FIGS. 5A–5C show different shaped discs that can be used in combination with the de-inking screens shown in FIGS. 1 and 2. FIG. 5A shows discs 80 that have perimeters shaped so that space $D_{sp}$ remains constant during rotation. In this example, the perimeter of discs 80 is defined by three sides having substantially the same degree of curvature. The disc perimeter shape rotates moving materials in an up and down and forward motion creating a sifting effect that facilitates classification.

FIG. 5B shows an alternative embodiment of a five-sided disc 82. The perimeter of the five-sided disc 82 has five sides with substantially the same degree of curvature. Alternatively, any combination of three, four, five, or more sided discs can be used.

FIG. 5C shows a compound disc 84 that can also be used with the de-inking screens to eliminate the secondary slot $D_{sp}$ that extends between discs on adjacent shafts. The compound disc 84 includes a primary disc 86 having three arched sides. A secondary disc 88 extends from a side face of the primary disk 86. The secondary disc 88 also has three arched sides that form an outside perimeter smaller than the outside perimeter of the primary disc 86.

During rotation, the arched shapes of the primary disc 86 and the secondary disc 88 maintain a substantially constant spacing with similarly shaped dual diameter discs on adjacent shafts. However, the different relative size between the primary discs 86 and the secondary discs 88 eliminate the secondary slot $D_{sp}$ that normally exists between adjacent shafts for single diameter discs. The discs shown in FIGS. 5A–5C can be made from rubber, metal, or any other fairly rigid material.

FIG. 6 shows how any of the discs shown in FIGS. 5A–5C can be used in combination with the de-inking shafts previously shown in FIGS. 1 and 2. For example, FIG. 6 shows a top view of a screen 90 that includes set of de-inking shafts 24 along with a vacuum shaft 60 and several dual diameter disc shafts 92. The different shafts can be arranged in any different combination according to the types of materials that need to be separated.

The primary discs 86 on the shafts 92 are aligned with the secondary discs 88 on adjacent shafts 92 and maintain a substantially constant spacing during rotation. The alternating alignment of the primary discs 86 with the secondary discs 88 both laterally across each shaft and longitudinally between adjacent shafts eliminate the rectangular shaped secondary slots that normally extended laterally across the entire width of the screen. Since large thin materials can no longer unintentionally pass through the screen, the large materials are carried along the screen and deposited in the correct location with other oversized materials.

The dual diameter discs 84, or the other single discs 80 or 82 shown in FIGS. 5A and 5B, respectively, can be held in place by spacers 94. The spacers 94 are of substantially uniform size and are placed between the discs 84 to achieve substantially uniform spacing. The size of the materials that are allowed to pass through openings 96 can be adjusted by employing spacers 94 of various lengths and widths.

Depending on the character and size of the debris to be classified, the diameter of the discs may vary. Again, depending on the size, character and quantity of the materials, the number of discs per shaft can also vary. In an alternative embodiment, there are no spacers used between the adjacent discs on the shafts.

It will be understood that variations and modifications may be effected without departing from the spirit and scope of the novel concepts of this invention.

What is claimed is:

1. A material separation screen, comprising:

multiple shafts aligned along a separation screen frame and configured to rotate in a direction causing paper products to move along the separation screen, the shafts configured with a shape and spacing so that substantially rigid pieces of the paper products move along the screen while non-rigid pieces of the paper products slide down between adjacent shafts.

2. A material separation screen according to claim 1 wherein the multiple shafts have a round cross-sectional shape with a substantially smooth outside surface.

3. A material separation screen according to claim 1 including at least one vacuum shaft having a set of air input holes configured to suck air for retaining the non-rigid pieces of the paper products.

4. A material separation screen according to claim 1 wherein the vacuum shaft includes a set of air output holes configured to blow air for dislodging the non-rigid pieces of the paper products retained by the input holes.

5. A material separation screen according to claim 4 including a divider located inside the vacuum shaft configured to separate the input holes from the output holes.

6. A material separation screen according to claim 1 including discs located on at least some of the shafts.

7. A material separation screen according to claim 6 wherein the discs have multiple sides that maintain a substantially constant spacing with discs on adjacent shafts.

8. A material separation screen according to claim 6 wherein at least some of the discs are dual diameter discs having a primary disc with a first outside perimeter and a secondary disc with a second outside perimeter smaller than the first outside perimeter.

9. A material separation screen according to claim 8 wherein the primary disc on a first shaft is aligned with the secondary disc on a second adjacent shaft and the secondary disc on the first shaft is aligned with the primary disc on the second adjacent shaft.

10. A material separation screen according to claim 9 wherein the dual diameter discs are aligned to form an overlapping stair stepped gap between dual diameter discs on adjacent shafts.

11. A method for separating materials, comprising:

loading materials onto a screen having multiple spaced apart shafts;

rotating the shafts so that the materials move from an in feed end toward an out feed end; and spacing the shafts so that rigid and semi-rigid materials are carried to the out feed end of the screen while more flexible and malleable materials slip down between the shafts before reaching the out feed end of the screen.

12. The method according to claim 11 including sucking air through holes in at least some of the shafts to retain the flexible materials.

13. The method of claim 12 including blowing air through other holes in at least some of the shafts to dislodge the retained materials.

14. The method of claim 11 including providing discs on at least some of the shafts that move the materials up and down while also moving the materials along the screen.

15. The method of claim 14 including sizing the discs so that they maintain a substantially constant spacing with discs on adjacent shafts while being rotated.

16. The method of claim 15 including:

providing dual diameter discs having both primary discs;

providing secondary discs that have a smaller perimeter size than the primary discs; and aligning the primary discs with secondary discs on adjacent shafts and aligning the secondary discs with primary discs on the adjacent shafts to form non-linear gaps between the dual diameter discs on adjacent shafts.

17. A vacuum shaft assembly for a material separation screen, comprising:

a shaft body including a hollow middle section and holes that extend through the shaft body;

an air pump fluidly coupled to the hollow middle section and configured to suck air through the holes and retain de-inking materials that are transported over the shaft body.

18. A shaft assembly according to claim 17 including a divider located inside the hollow middle section for separating the middle section into at least two different chambers, a first chamber coupled to an air output flow from the air pump and a second chamber fluidly coupled to an air input flow from the air pump.

19. A shaft assembly according to claim 18 wherein the holes located over the first chamber suck air for retaining the de-inking materials that pass over the shaft body and the holes located over the second chamber blow air for dislodging the retained de-inking materials.

* * * * *